US005243152A

United States Patent [19]

Magid

[11] Patent Number: 5,243,152

[45] Date of Patent: Sep. 7, 1993

[54] SOUND ANTI-MUFFLER FOR A SOUND GENERATOR

[76] Inventor: Sidney H. Magid, 4th Fl., No. 10, Lane 169, Da-An Rd., Taipei, Taiwan

[21] Appl. No.: 693,439

[22] Filed: Apr. 29, 1991

[51] Int. Cl.[5] ..... G10K 11/00

[52] U.S. Cl. ..... 181/191; 340/574

[58] Field of Search ..... 181/150, 154, 155, 148, 181/149, 191; 340/574, 693, 573, 784 E

[56] References Cited

U.S. PATENT DOCUMENTS

| | | | |
|---|---|---|---|
| 2,623,606 | 12/1952 | Corke | 181/155 |
| 4,303,807 | 12/1981 | Sato | 181/155 |
| 4,837,559 | 6/1989 | Green, Sr. | 340/574 |
| 4,918,738 | 4/1990 | Bader | 181/155 X |

*Primary Examiner*—Michael L. Gellner
*Assistant Examiner*—Khanh Dang
*Attorney, Agent, or Firm*—Kinney & Lange

[57] ABSTRACT

A sound anti-muffler provides at least one sound channel to permit sound from a sound generator to travel sideways to the outside air even though a hand is placed over the sound anti-muffler in an attempt to muffle the sound.

14 Claims, 3 Drawing Sheets

SOUND ANTI-MUFFLER FOR A SOUND GENERATOR

BACKGROUND OF THE INVENTION

1. Field of the Invention

The invention relates to a sound generator, such as a personal attack alarm, more particularly to a sound generator having a sound anti-muffler.

2. Description of the Related Art

A typical example of a sound generator is a portable electronic personal attack alarm which is to be carried by women or other persons who are at risk of being attacked. Commercially available personal attack alarms mainly comprise a casing and a sound output device (such as a loudspeaker) provided inside the casing. A main disadvantage of conventional personal attack alarms is that when an attacker manages to grab the attack alarm, he can easily muffle the alarm sound output thereof by simply placing his hand over the casing at a position directly in front of the sound output device. The alarm sound output of the personal attack alarm is thus deadened, rendering the attack alarm useless since the alarm sound output thereof can be heard over only relatively short distances.

SUMMARY OF THE INVENTION

Therefore, the main objective of the present invention is to provide a sound anti-muffler for a sound generator, such as a hand held personal attack alarm, which sound anti-muffler provides at least one sound channel to the outside air even though a hand is placed over the sound anti-muffler.

The sound anti-muffler may be made in any configuration, as long as there is at least one clear passage for sound produced by a sound output device of the sound generator to travel sideways to the outside air. This configuration can be formed as raised parallel strips, raised radial strips which are joined at one end, raised stubs, or as openings formed in the sound generator casing.

The sound anti-muffler can be integrally molded with the casing or can be attached to the casing by known means, such as adhesives, rivets or screws, etc. Other configurations which permit detaching of the sound anti-muffler from the casing are also presented.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
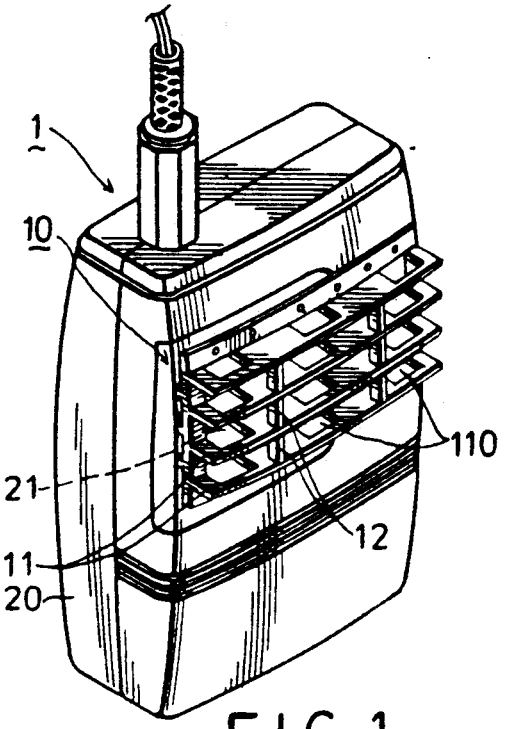
FIG. 1 is a perspective view of the first preferred embodiment of a sound anti-muffler when mounted on a sound generator in accordance with the present invention.

Referring to FIG. 1, the first preferred embodiment of a sound anti-muffler 10 is shown to comprise a plurality of perforated parallel strips 11, each of which has a preferred width of between one-fourth and one-half inch. A plurality of transverse strips 12 are provided between any two adjacent parallel strips 11. The rearmost edge of the transverse strips 12 is displaced by at least one-eight of an inch from the rearmost edge of the parallel strips 11. The sound anti-muffler 10 is made of a rigid material, such as rigid plastic, and is mounted on a rigid casing 20 of the sound generator 1 at a position directly in front of a sound output device 21 inside the casing 20. In this Figure, the sound anti-muffler 10 is mounted on the casing 20 by screws, although equivalent means, such as adhesion, may be employed. Note that the parallel strips 11 extend along the width of the casing 20. The lengths of the parallel strips 11, however, may be shortened as long as the parallel strips 11 remain extended along the width of the sound output device 21.

When a hand is placed over the sound anti-muffler 10, sound coming from the sound output device 21 does not travel forward from the casing 10 since the hand blocks passage of sound in this direction. Sound, however, can travel sideways via sound channels formed between two adjacent parallel strips 11, or via openings 110 provided in the parallel strips 11. Muffling of the sound generator 1 is thus prevented.

Figure 2:
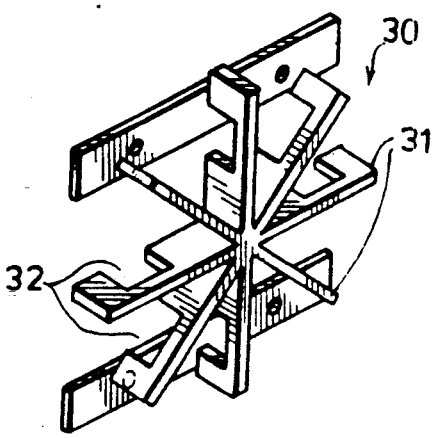
FIG. 2 is a perspective view of the second preferred embodiment of a sound anti-muffler of the present invention.

The second preferred configuration of a sound anti-muffler according to the present invention is shown in FIG. 2. The sound anti-muffler 30 comprises a plurality of radially extending strips 31. The radial strips 31 may or may not be joined at one end and each may be provided with an opening 32. The preferred width of the radial strips 31 is similarly between one-fourth and one-half inch. As with the first preferred embodiment, the sound anti-muffler 30 is made of a rigid material and is mounted on the casing of the sound generator at a position directly in front of the sound output device inside the casing. The mounting and operation of the second preferred embodiment is similar to that of the first preferred embodiment and will not be detailed further.

Figure 3:
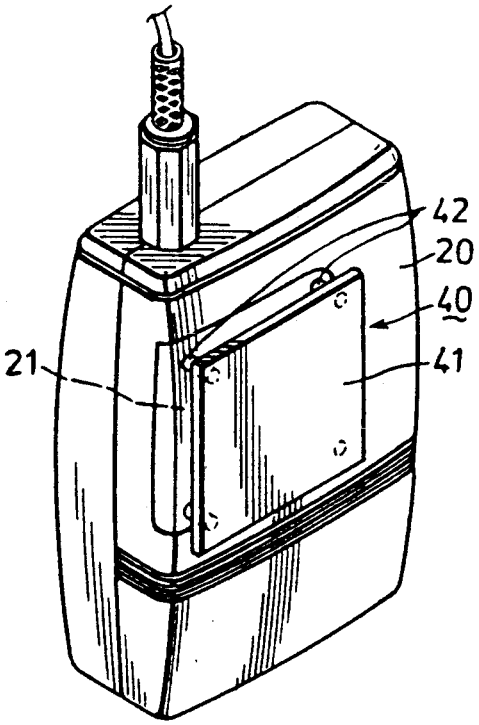
FIG. 3 is a perspective view of the third preferred embodiment of a sound anti-muffler when mounted on a sound generator in accordance with the present invention.

The third preferred embodiment of a sound anti-muffler according to the present invention is shown in FIG. 3. The sound anti-muffler 40 comprises a rigid protective plate 41 which covers a portion of the casing 20 that is directly in front of the sound output device 21, and a plurality of support protrusions 42 extending forward from the casing 20 to interconnect and space the protective plate 41 from the casing 20. The length of the support projections 42 is preferably at least one-eighth inch. The clearance between the protective plate 41 and the casing 20 permits sound to travel sideways even if a hand is placed over the sound anti-muffler 40.

Figure 4:
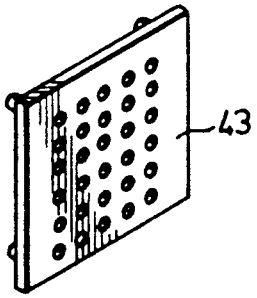
FIG. 4 is a perspective view of the fourth preferred embodiment of a sound anti-muffler of the present invention.

The protective plate 41 of the sound anti-muffler 40 may be replaced by a perforated protective plate 43, as shown in FIG. 4. This permits sound to travel forward from the sound output device as long as no object is placed over the protective plate 43.

Figure 5:
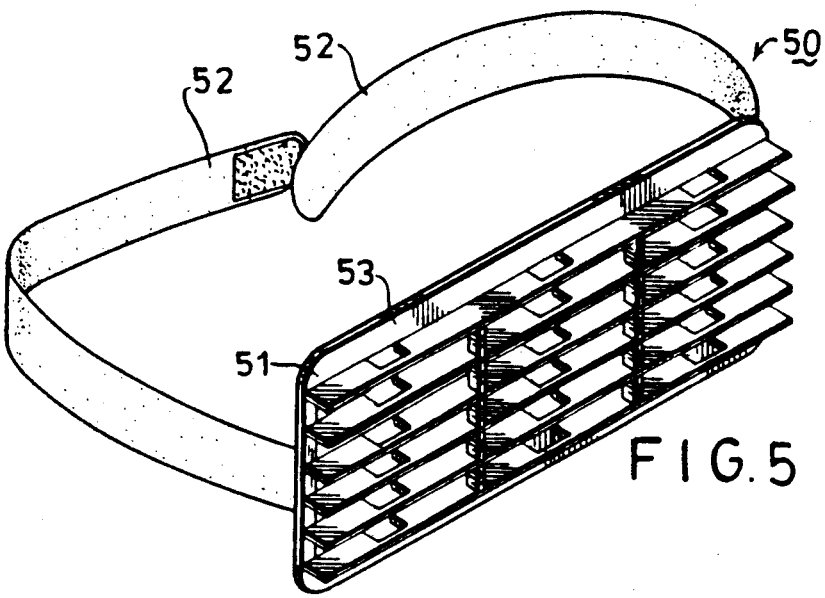
FIG. 5 is a perspective view of the fifth preferred embodiment of a sound anti-muffler which can be mounted detachably on the sound generator.

FIG. 5 illustrates a preferred embodiment of a sound anti-muffler which is detachable from the sound generator. The sound anti-muffler 50 comprises a thin sheet 51, a perforated part of which detachably covers a portion of the sound generator casing located directly in front of the sound output device. Elongated straps 52 are attached to both ends of the sheet 51. VELCRO hook and loop fasteners are provided on the free ends of the elongated straps 52 to permit strapping of the sheet 51 onto the sound generator casing. The sheet 51 may be mounted on the sound generator casing by other means, such as pressure sensitive adhesives. A protrusion means 53 is mounted on and extends forward from the sheet 51. In this Figure, the configuration of the protrusion means 53 is substantially similar to the sound anti-muffler 10 shown in FIG. 1 and will not be detailed further. Note that the protrusion means 53 extends along the entire length of the sheet 51. As with the first preferred embodiment, the length of the protrusion means 53 may also be shortened as long as the protrusion means 53 remains extended along the width of the sound output device when the sound anti-muffler 50 is attached to the sound generator.

Figure 6:
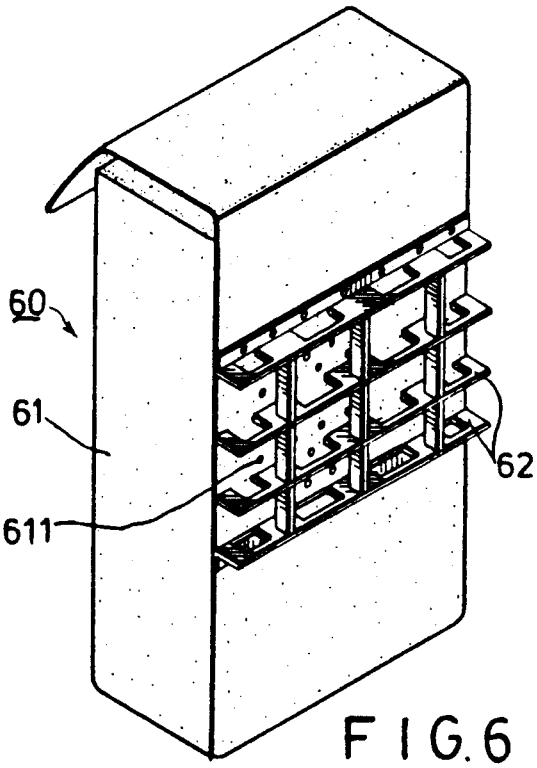
FIG. 6 is a perspective view of the sixth preferred embodiment of a sound anti-muffler which can be similarly mounted detachably on the sound generator.

FIG. 6 illustrates another preferred embodiment of a sound anti-muffler which is detachable from the sound generator. The sound anti-muffler 60 comprises a soft flexible pouch 61 to cover the entire sound generator casing. The pouch 61 has a perforated portion 611 to be located directly in front of the sound output device of the sound generator. A protrusion means 62 is mounted, in a known manner, on the perforated portion 611, by means of washers and eyelets. The configuration of the protrusion means 62 is substantially similar to the sound anti-muffler 10 shown in FIG. 1 and will not be detailed further.

Figure 7:
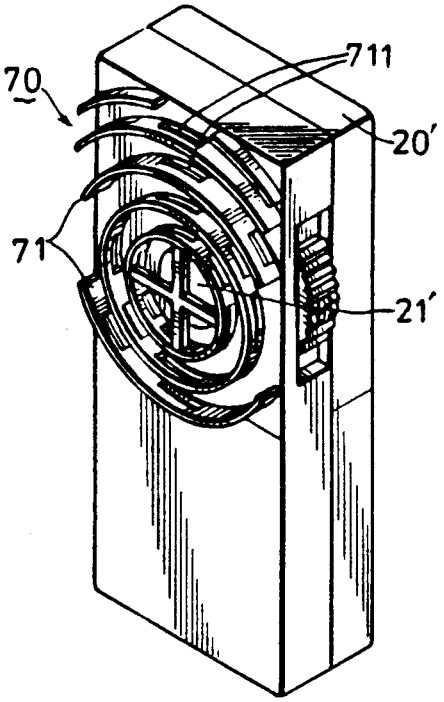
FIG. 7 is a perspective view of the seventh preferred embodiment of a sound anti-muffler which is integrally molded with the casing of a sound generator.

Referring to FIG. 7, another preferred embodiment of a sound anti-muffler is shown to be integrally molded with a sound generator casing 20' at a position directly in front of the sound output device 21'. The sound anti-muffler 70 comprises a plurality of concentric annular strips 71, each of which is formed with a plurality of breaks and/or openings 711. The operation of the sound anti-muffler 70 is also similar to that of the first preferred embodiment and will not be detailed herein.

Figure 8:
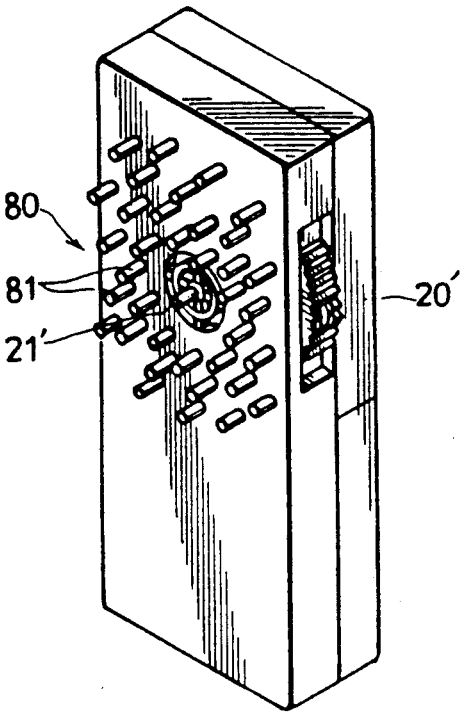
FIG. 8 is a perspective view of the eighth preferred embodiment of a sound anti-muffler which is similarly integrally molded with the casing of a sound generator.

Still another preferred embodiment of a sound anti-muffler which is integrally molded with a sound generator casing is shown in FIG. 8. The sound anti-muffler 80 comprises a plurality of indiscriminately arranged stubs 81 extending forward from the casing 20' at a position in front of and surrounding the sound output device 21'.

Figure 9:
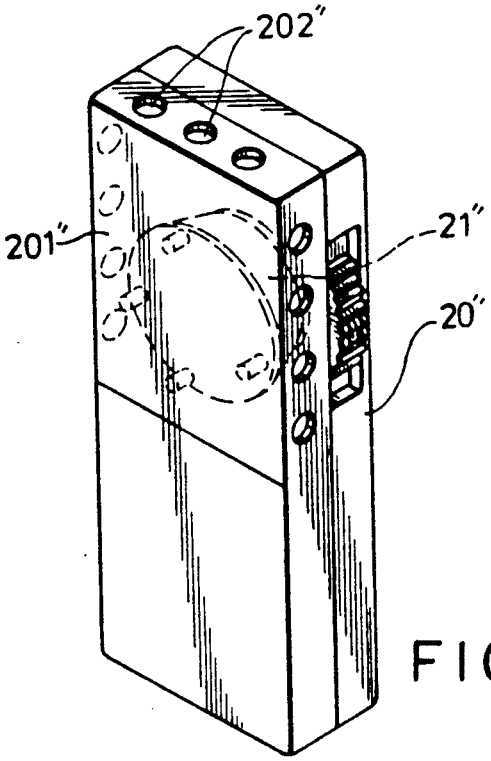
FIG. 9 is a perspective view of the ninth preferred embodiment of a sound anti-muffler which is incorporated with the casing of a sound generator.

FIG. 9 is yet another preferred embodiment of a sound generator incorporating a sound anti-muffler according to the present invention. In this Figure, the sound output device 21'' is similarly provided inside the sound generator casing 20'' but is spaced by approximately one-eighth of an inch from the rear surface of a front wall 201'' of the sound generator casing 20''. The side walls of the sound generator casing 20'' within the immediate surrounding of the sound output device 21'' are each provided with openings 202''. The openings 202'' permit sound to travel sideways from the sound output device 21'' to the outside air even though a hand is placed over the front wall 201'' of the sound generator casing 20'' in an attempt to muffle the sound.

It has thus been shown that the sound anti-muffler of the present invention may be made in any configuration, as long as there is at least one clear passage to permit sound produced by a sound output device of the sound generator to travel sideways to the outside air. For example, a sound anti-muffler configured as a raised perforated spiral strip (not shown) disposed on the sound generator casing at a position directly in front of the sound output device would also accomplish the desired objective of the present invention. Furthermore, the sound anti-muffler can be made as an integral part of the sound generator casing, or as a part of a sound generator accessory which is detachable from the sound generator casing.

While the present invention has been described in connection with what is considered the most practical and preferred embodiments, it is understood that this invention is not limited to the disclosed embodiments, but is intended to cover various arrangements included within the spirit and scope of the broadest interpretation so as to encompass all such modifications and equivalent arrangements.

I claim:

1. A sound generator having a palm-sized casing and a sound output device provided inside said casing, said casing having one side which is directly in front of an output side of said sound output device, said one side having an area which is capable of sound transmission and which is within the reach of the palm of a hand when said casing is gripped, said area having an exposed outer surface, the sound generator comprising:

a sound anti-muffler which is mounted on and which protrudes and extends directly from said exposed outer surface of said area, said sound anti-muffler providing at least one sound channel to permit sound to travel sideways from said sound output device to the outside air even though a hand is placed over said sound anti-muffler in an attempt to muffle the sound;

wherein said sound anti-muffler comprises a plurality of parallel strips extending forward from said portion of said casing;

wherein said parallel strips are perforated.

2. The sound generator as claimed in claim 1, wherein said sound anti-muffler further comprises at least one transverse strip provided between two adjacent said parallel strips, said transverse strip having a rearmost edge spaced from rearmost edges of said parallel strips.

3. The sound generator as claimed in claim 2, wherein each of said parallel strips has a width between one-fourth inch and one-half inch.

4. The sound generator as claimed in claim 3, wherein said rearmost edge of said transverse strip is spaced by at least one-eighth inch from said rearmost edges of said parallel strips.

5. A sound generator having a palm-sized casing and a sound output device provided inside said casing, said casing having one side which is directly in front of an output side of said sound output device, said one side having an area which is capable of sound transmission and which is within the reach of the palm of a hand when said casing is gripped, said area having an exposed outer surface, the sound generator comprising:

a sound anti-muffler which is mounted on and which protrudes and extends directly from said exposed outer surface of said area, said sound anti-muffler providing at least one sound channel to permit sound to travel sideways from said sound output device to the outside air even though a hand is placed over said sound anti-muffler in an attempt to muffle the sound;

wherein said sound anti-muffler comprises a plurality of radial strips extending forward from said exposed outer surface of said area.

6. The sound generator as claimed in claim 5, wherein said radial strips are joined together at one end.

7. A sound generator having a palm-sized casing and a sound output device provided inside said casing, said casing having one side which is directly in front of an output side of said sound output device, said one side having an area which is capable of sound transmission and which is within the reach of the palm of a hand when said casing is gripped, said area having an exposed outer surface, the sound generator comprising:

a sound anti-muffler which is mounted on and which protrudes and extends directly from said exposed outer surface of said area, said sound anti-muffler providing at least one sound channel to permit sound to travel sideways from said sound output device to the outside air even though a hand is placed over said sound anti-muffler in an attempt to muffle the sound;

wherein said sound anti-muffler comprises a protective plate and at least one support protrusion extending forward from said exposed outer surface of said area to interconnect said protective plate and said casing.

8. The sound generator as claimed in claim 7, wherein said protective plate is perforated.

9. The sound generator as claimed in claim 7, wherein said support protrusion has a length of at least one-eighth inch.

10. A sound generator having a palm-sized casing and a sound output device provided inside said casing, said casing having one side which is directly in front of an output side of said sound output device, said one side having an area which is capable of sound transmission and which is within the reach of the palm of a hand when said casing is gripped, said area having an exposed outer surface, the sound generator comprising:

a sound anti-muffler which is mounted on and which protrudes and extends directly from said exposed outer surface of said area, said sound anti-muffler providing at least one sound channel to permit sound to travel sideways from said sound output device to the outside air even though a hand is placed over said sound anti-muffler in an attempt to muffle the sound;

wherein said sound anti-muffler comprises a plurality of stubs extending forward from said exposed outer surface of said area.

11. A sound anti-muffler for a sound generator, said sound generator having a palm-sized casing and a sound output device provided inside said casing, said casing having a first side which is directly in front of an output side of said sound output device and a second side, said first side having an area which is capable of sound transmission and which is within the reach of the palm of a hand when said casing is gripped, said area having an exposed outer surface, said sound anti-muffler comprising:

a sound generator accessory detachably associated with said casing, said sound generator accessory having a part which covers at least said exposed outer surface of said area and being adapted to engage detachably at least said second side of said casing; and a protrusion means mounted on and protruding and extending forward from said part of said sound generator accessory, said protrusion means providing at least one sound channel to permit sound from said sound output device to travel sideways to the outside air even though a hand is placed over said sound anti-muffler in an attempt to muffle the sound.

12. The sound anti-muffler as claimed in claim 11, wherein said sound generator accessory is a soft pouch having perforations on said part thereof.

13. The sound anti-muffler as claimed in claim 11, wherein said sound generator accessory comprises:

a thin sheet having at least one opening on said part thereof; and a fastening means to attach said sheet to said sound generator.

14. The sound anti-muffler as claimed in claim 13, wherein said fastening means comprises a pair of elongated straps attached to both ends of said sheet, and hook and loop fasteners provided on free ends of said elongated straps.

* * * * *